US005219126A

United States Patent [19]

Schutz

[11] Patent Number: 5,219,126

[45] Date of Patent: Jun. 15, 1993

[54] DISPENSER FOR SEQUENTIALLY DISPENSING SHEET MATERIAL FROM A PLURALITY OF ROLLS

[75] Inventor: Rudolph W. Schutz, Walnut Creek, Calif.

[73] Assignee: James River II, Inc., Oakland, Calif.

[21] Appl. No.: 885,815

[22] Filed: May 20, 1992

[51] Int. Cl.[5] ..... B65H 16/02

[52] U.S. Cl. ..... 242/55.42; 242/55.53; 242/55.54; 242/55.3; 206/390; 206/391; 206/393; 206/394; 206/409

[58] Field of Search ..... 242/55.53, 55.54, 55.3, 242/55.42; 221/34, 45, 46, 63; 206/391, 393, 394, 390, 409; 225/106

[56] References Cited

U.S. PATENT DOCUMENTS

| | | | |
|---|---|---|---|
| 2,302,850 | 11/1942 | Funke . | |
| 2,864,495 | 12/1958 | Ritchie . | |
| 2,908,451 | 10/1959 | Tucker et al. . | |
| 2,991,951 | 7/1961 | Carroll . | |
| 3,126,234 | 3/1964 | Batlas et al. | 242/55.53 |
| 3,310,167 | 3/1967 | Knox . | |
| 3,316,040 | 4/1967 | McGann | 242/55.53 |
| 3,523,653 | 8/1970 | Hansen | 242/55.53 |
| 3,627,216 | 12/1971 | Ekuan | 242/55.54 |
| 4,177,948 | 12/1979 | Poole . | |
| 4,756,460 | 7/1988 | Ornros . | |
| 4,760,970 | 8/1988 | Larsson et al. . | |
| 4,905,868 | 3/1990 | Beane et al. . | |
| 5,015,089 | 5/1991 | Radov . | |

*Primary Examiner*—Clifford D. Crowder
*Assistant Examiner*—Gloria Hale
*Attorney, Agent, or Firm*—Thomas R. Lampe

[57] ABSTRACT

A dispenser having a dispensing aperture accommodates two coreless rolls of sheet material. The tail end of one of the rolls is attached to the lead end of the other of the rolls to provide for sequential dispensing of the rolls.

11 Claims, 1 Drawing Sheet

DISPENSER FOR SEQUENTIALLY DISPENSING SHEET MATERIAL FROM A PLURALITY OF ROLLS

TECHNICAL FIELD

This invention relates to dispenser apparatus for sequentially dispensing sheet material from a plurality of rolls. The teachings of the invention are particularly applicable to coreless paper rolls and for automatically initiating dispensing from a reserve coreless paper roll in response to depletion of a primary coreless paper roll.

BACKGROUND ART

It is well known in the prior art to dispense paper tissue, toweling and the like from coreless rolls of such product. For example, U.S. Pat. No. 4,905,868, issued Mar. 6, 1990, discloses a paper towel dispenser including a housing accommodating a coreless roll and a nozzle of particular construction which defines an outlet through which the toweling is pulled.

U.S. Pat. No. 4,760,970, issued Aug. 2, 1988, also discloses a dispenser for dispensing paper toweling or the like from a roll of such material. The web is pulled from the center of a roll through the bottom of the dispenser. An arrangement is provided to prevent unwanted dispensing of the web under the influence of gravity.

Other dispensers for dispensing from coreless rolls of web material are disclosed in U.S. Pat. No. 3,627,216, issued Dec. 14, 1971, U.S. Pat. No. 3,523,653, issued Aug. 11, 1970, and U.S. Pat. No. 2,864,495, issued Dec. 16, 1958.

All of the dispenser mechanisms shown in the above listed patents are for the purpose of accommodating and dispensing from a single coreless roll. Once that roll has been depleted an attendant must refill the dispenser with another roll. This is highly undesirable since a person wishing to use a towel or tissue, whichever the case may be, will find that none is available in the interim between roll depletion and replacement. On the other hand, replacement before depletion results in waste.

While it is known in the prior art to store a plurality of paper toweling or tissue rolls in a cabinet, and in some cases effect automatic transfer therebetween, some of these arrangements do not readily lend themselves to use with coreless rolls, while in other cases such transfer mechanisms are characterized by their relative complexity and high expense. A search of the prior art located the following dispensers for dispensing toilet tissue and the like which accommodate a plurality of such rolls: U.S. Pat. No. 2,991,951, issued Jul. 11, 1961, U.S. Pat. No. 4,177,958, issued Dec. 11, 1979, and U.S. Pat. No. 2,908,451, issued Oct. 13, 1959.

A search directed to the present invention also located the following U.S. Pat. Nos.: 2,302,850, issued Nov. 24, 1942, 4,756,460, issued Jul. 12, 1988, 3,310,167, issued Mar. 21, 1967, and 5,015,089, issued May 14, 1991. These patents do not disclose a dispenser arrangement providing for the serially dispensing of coreless, center-pull rolls of paper toweling, tissue or the like.

DISCLOSURE OF INVENTION

The present invention relates to a system for dispensing sheet material in a serial fashion from more than one coreless roll of such material. The dispenser constructed in accordance with the teachings of the present invention is characterized by its simplicity and relatively low cost. Furthermore, the means of effecting transfer between the rolls during dispensing is highly reliable and virtually fool proof, both as to preparation and use. Additionally, transfer takes place without waste of the sheet material.

The dispenser means of the present invention defines a dispensing aperture. A first coreless roll of sheet material is in operative association with the dispenser means and includes a lead end and a tail end. The lead end is projectable outwardly from the center of the first coreless roll for passage through the dispensing aperture.

The combination also includes a second coreless roll of sheet material including a lead end and a tail end. The tail end of the first coreless roll is connected to the lead end of the second coreless roll whereby the second coreless roll lead end will follow the first coreless roll tail end through the dispenser aperture upon depletion of the first coreless roll. Thus, the first and second coreless rolls are sequentially dispensed through the dispenser opening.

The first and second coreless rolls are in general axial alignment relative to each other and relative to the dispensing aperture. In one embodiment of the invention, the first coreless roll is located closer to the dispenser aperture than the second coreless roll. And in a second embodiment of the invention, the second coreless roll is located closer to the dispensing aperture than the first coreless roll.

The system of the present invention also encompasses a method of dispensing sheet material from a plurality of coreless rolls of the sheet material, each of the coreless rolls having a lead end and a tail end.

According to the method, a first coreless roll is positioned at a predetermined location relative to a dispensing aperture. The lead end of the first coreless roll is passed through the dispensing aperture whereby the first coreless roll lead end projects outwardly from the dispensing aperture.

A second coreless roll is then positioned adjacent to the first coreless roll at a second predetermined location.

The tail end of the first coreless roll is connected to the lead end of the second coreless roll.

The first coreless roll is depleted by dispensing the sheet material thereof through the dispensing aperture and the second coreless roll lead end is pulled through the dispenser aperture responsive to depletion of the first coreless roll. The sheet material of the second coreless roll is then dispensed through the dispensing aperture.

Other features, advantages, and objects of the present invention will become apparent with reference to the following description and accompanying drawings.

MODES FOR CARRYING OUT THE INVENTION

Figure 2:
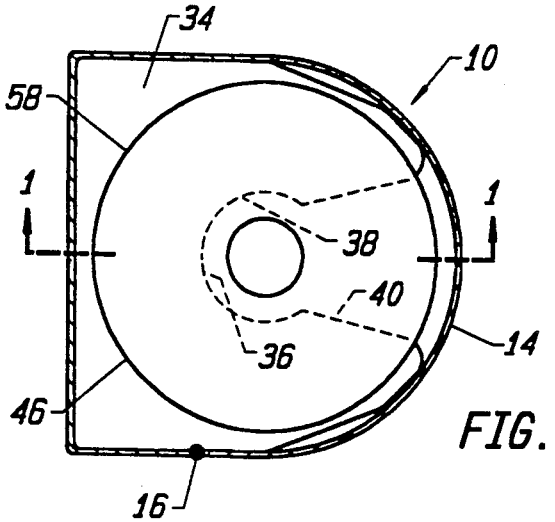
FIG. 2 is a cross-sectional view taken along the line 2—2 of FIG. 1.
Figure 1:
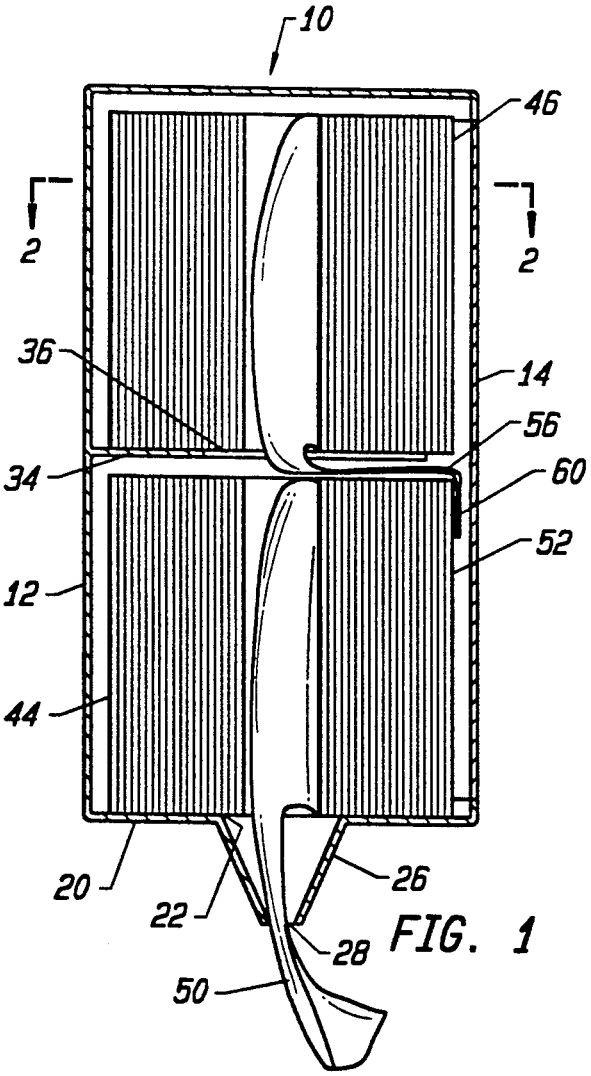
FIG. 1 is a cross-sectional, elevational view of a dispenser constructed in accordance with the teachings of the present invention and accommodating therein two coreless rolls of paper product.

Referring now to FIGS. 1 and 2, a dispenser constructed in accordance with the teachings of the present invention is designated generally by reference numeral 10. Dispenser 10 includes a housing having a fixed side wall 12 and a closure 14 hingedly mounted on side wall 12 by pivot 16. A suitable latch mechanism (not shown) may be employed to maintain the closure 14 in the illustrated closed position until access to the interior of the dispenser is desired, as for example, to replenish the contents thereof.

Dispenser 10 also includes a bottom wall 20 defining a centrally disposed, circular dispensing aperture 22. A truncated cone-like dispenser element 26 projects downwardly from the bottom wall 20 and defines a passageway leading from dispensing aperture 22, said passageway continuously converging in a downward direction and terminating at a restricted opening 28.

A platform 34 is connected to housing side wall 12 and projects into the interior defined by the side wall and closure 14. Platform 34 defines an opening 36 spaced from dispensing aperture 22 and in communication therewith. Opening 36 includes a generally circular segment 38 and a diverging slot segment 40 which extends to the edge of the platform facing closure 14.

Dispenser 10 accommodates therein two coreless rolls of sheet material in the form of paper towel rolls 44, 46. As is conventional with dispensing of coreless paper rolls, rolls 44, 46 are disposed on end and have toweling dispensed therefrom from the roll interior or center by exerting a pulling force on toweling projecting from the roll interior or center.

Roll 44 has a lead end 50 which is shown projecting from the center of roll 44 downwardly through dispensing aperture 22 and out of the restricted opening 28 of dispenser element 26. As is conventional, a user wishing to remove a towel from roll 44 pulls the lead end 50 downwardly to a desired extent and then separates a towel from the rest of the toweling by working the toweling against the dispenser element. In the case of perforated toweling, this can be accomplished merely by pulling the projecting toweling laterally against the bottom of dispenser element 26 to tear the towel along a perforated line separating same from the rest of the toweling. Although not illustrated, dispenser elements also exist which incorporate cutting teeth or blades to sever the towel from the remainder of the toweling web, such an arrangement being particularly useful when dispensing towels from rolls of nonperforated toweling. It will be appreciated that the principles of the present invention readily may be applied to both perforated and nonperforated toweling.

Roll 44 has a tail end 52 defining at least a portion of the outermost convolution of the roll. Tail end 52, of course, is the last of the toweling of roll 44 dispensed from the dispenser.

Positioned on platform 34 in general axial alignment relative to roll 44 and dispensing aperture 22 is the roll 46 which also has a lead end, lead end 56, and a tail end, tail end 58.

Roll 46 operates as a reserve roll. That is, toweling is dispensed from roll 46 after depletion of roll 44. With the arrangement of the present invention, this transfer is effected automatically upon depletion of roll 44. Furthermore, transfer is accomplished reliably and without the necessity of utilizing complex, expensive towel transfer mechanisms. There is no toweling waste occasioned by said transfer.

According to the teachings of the present invention, the lead end 56 of roll 46 is connected or secured to the tail end 52 of roll 44. In the arrangement illustrated, such securement is accomplished by connector means in the form of a length of adhesive tape 60 secured to both lead end 56 and tail end 52 in the manner illustrated in FIG. 1. Other means for interconnecting the lead and tail ends may be employed. For example, it has been found that an operable connection may be formed by bringing the lead and tail ends into engagement and manually crumpling or collapsing the lead and tail ends together to provide securement therebetween. Of course this latter approach may not provide as positive a connection as use of a separate connector element such as adhesive tape.

Upon depletion of roll 44 during dispensing, the lead end 56 of roll 46 will follow the tail end 52 through dispensing aperture 22 and out of the restricted opening 28 of dispenser element 26 to present lead end 56 in dispensing position wherein it projects from the dispenser element. The toweling of roll 46 may then be dispensed in normal fashion.

If the dispenser is serviced before depletion of roll 46, such partially depleted roll is transferred to the lowermost location in the dispenser and replaced by another reserve roll which is positioned on platform 34. Of course, the lead end of the new roll is attached to the outer convolution or tail end of roll 46 to ensure that automatic transfer takes place upon depletion of roll 46. The fact that the opening 36 in the platform extends to the edge thereof facilitates this operation.

Figure 3:
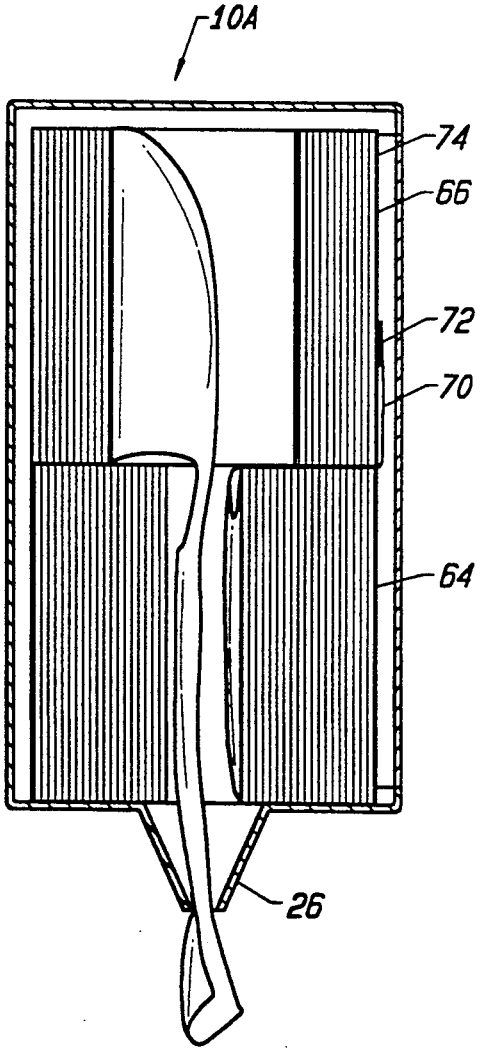
FIG. 3 is a view similar to FIG. 1, but illustrating an alternative embodiment of the invention.

FIG. 3 shows an alternative embodiment of the present invention. In this embodiment, dispenser 10A does not require a platform, such as platform 34 of the FIG. 1 embodiment, for supporting a roll.

Instead, two rolls 64, 66 are stacked in end-to-end engagement. Utilizing this approach, the topmost roll, roll 66, is dispensed first, the lead end of same passing downwardly through the open center of roll 64 and thence out of the dispenser element 26. The lead end 70 of the lower roll 64 passes between the abutting ends of the rolls and is secured as by adhesive tape 72 to the tail end 74 of roll 66. It will be appreciated that when roll 66 is depleted, tail end 74 thereof will carry lead end 70 of roll 64 downwardly through the interior of the roll 64 and out of the dispenser. Thus, dispensing from roll 64 may then be accomplished in the normal manner.

While the two embodiments illustrated provide for serial transfer between two rolls, it will be appreciated that the principles of the present invention may be applied where more than two rolls are being dispensed.

I claim:

1. In combination:

dispenser means defining a dispensing aperture;

a first coreless roll of sheet material in operative association with said dispenser means and including a lead end and a tail end, said lead end projectable outwardly from the center of said first coreless roll for passage through said dispensing aperture; and a second coreless roll of sheet material including a lead end and a tail end, the tail end of said first coreless roll being connected to the lead end of said second coreless roll whereby said second coreless roll lead end will follow said first coreless roll tail end through said dispensing aperture upon depletion of said first coreless roll and said first and second coreless rolls are sequentially dispensed through said dispensing aperture.

2. The combination according to claim 1 wherein said first and second coreless rolls are in general axial alignment relative to each other and relative to said dispensing aperture.

3. The combination according to claim 1 wherein said first coreless roll is located closer to said dispensing aperture than said second coreless roll.

4. The combination according to claim 1 wherein said second coreless roll is located closer to said dispensing aperture than said first coreless roll.

5. The combination according to claim 1 additionally comprising connector means for connecting the tail end of said first coreless roll to the lead end of said second coreless roll, said connector means comprising a connector element adhesively secured to said first coreless roll tail end and said second coreless roll lead end.

6. The combination according to claim 2 wherein said first coreless roll and said second coreless roll are stacked and in engagement at adjacent ends thereof.

7. The combination according to claim 1 wherein said dispenser means additionally comprises a roll support spaced from said dispensing aperture for supporting said second coreless roll and maintaining said second coreless roll in spaced relationship relative to said first coreless roll.

8. The combination according to claim 7 wherein said roll support comprises a platform, said platform defining an opening spaced from said dispensing aperture, sheet material from said second coreless roll passing consecutively through said opening and thence through said dispensing aperture during dispensing of sheet material from said second coreless roll.

9. The combination according to claim 8 wherein said opening in said platform extends to an edge of said platform to facilitate connecting of said first coreless roll tail end and said second coreless roll lead end.

10. A dispenser in combination with a plurality of coreless rolls of sheet material for serially dispensing sheet material from said plurality of coreless rolls of sheet material, said dispenser including first support means supporting a first coreless roll having a lead end and a tail end, said first support means defining a dispensing aperture, and second support means supporting a second coreless roll having a lead end and a tail end in spaced relation to said first coreless roll with the lead end of said second cordless roll connected to the tail end of said first coreless roll, said second support means having an opening in communication with said dispensing aperture whereby sheet material from said second coreless roll may pass consecutively through said opening and said dispensing aperture.

11. A method of dispensing sheet material from a plurality of coreless rolls of said sheet material, each said coreless roll having a lead end and a tail end, said method comprising the steps of:

positioning a first coreless roll at a predetermined location relative to a dispensing aperture;

passing the lead end of said first coreless roll through said dispensing aperture whereby said first coreless roll lead end projects outwardly from said dispensing aperture;

positioning a second coreless roll adjacent to said first coreless roll at a second predetermined location;

connecting the tail end of said first coreless roll and the lead end of said second coreless roll;

depleting said first coreless roll by dispensing the sheet material thereof through said dispensing aperture;

pulling said second coreless roll lead end through said dispensing aperture responsive to depletion of said first coreless roll; and dispensing the sheet material of said second coreless roll through said dispensing aperture.

* * * * *